United States Patent [19]

Masaki

[11] Patent Number: 4,821,690

[45] Date of Patent: Apr. 18, 1989

[54] ENERGIZATION CONTROL APPARATUS FOR GLOW PLUG

[75] Inventor: Minoru Masaki, Saitama, Japan

[73] Assignee: Jidosha Kiki Co., LTD., Tokyo, Japan

[21] Appl. No.: 196,143

[22] Filed: May 19, 1988

[30] Foreign Application Priority Data

May 20, 1987 [JP] Japan ..... 62-121386

[51] Int. Cl.[4] ..... F02N 17/00; F02P 19/02

[52] U.S. Cl. ..... 123/179 H; 123/145 A; 123/145 R; 123/179 BG; 219/497

[58] Field of Search ..... 123/179 H, 145 A, 143 R, 123/179 BG; 219/497, 515, 499, 270, 205; 361/266

[56] References Cited

U.S. PATENT DOCUMENTS

| | | | |
|---|---|---|---|
| 4,375,205 | 3/1983 | Green | 123/145 A |
| 4,399,781 | 8/1983 | Tsukasaki | 123/145 A |
| 4,444,160 | 4/1984 | Steele | 123/145 A |
| 4,458,639 | 7/1984 | Aba et al. | 123/145 A |
| 4,478,181 | 10/1984 | Kikuchi et al. | 123/145 A |
| 4,483,284 | 11/1984 | Andraasson | 123/145 A |
| 4,552,102 | 11/1985 | Egla | 123/145 A |
| 4,594,975 | 6/1986 | Shiganobu | 123/179 H |
| 4,606,306 | 8/1986 | Caron et al. | 123/179 H |
| 4,607,153 | 8/1986 | Aorg et al. | 123/179 H |
| 4,635,594 | 1/1987 | Ichikawa et al. | 123/179 H |

*Primary Examiner*—Raymond A. Nelli

*Attorney, Agent, or Firm*—Blakley, Sokoloff, Taylor & Zafman

[57] ABSTRACT

An energization control apparatus for a glow plug connected between ground and the emitter of an npn transistor and turning on/off the npn transistor to control an amount of power to be supplied to the glow plug includes a control signal generator (20) for generating a control signal for turning on/off the npn transistor. The control apparatus also includes a base voltage booster, arranged between the control signal generating means the a base of the npn transistor, for boosting a base voltage such that the npn transistor is operated in a saturation region regardless of load variations.

4 Claims, 3 Drawing Sheets

ENERGIZATION CONTROL APPARATUS FOR GLOW PLUG

BACKGROUND OF THE INVENTION

The present invention relates to an energization control apparatus for a glow plug in a diesel engine.

In a conventional diesel engine, a glow plug is mounted on each combustion chamber of a cylinder head to facilitate starting of the engine during a cold period. When the engine is to be started, the glow plug is energized and heated to increase a compressed air temperature of the cylinder head to assure starting of the engine. In general, in such a glow plug, power is supplied to the glow plug through an energization control apparatus which is operated simultaneously with ON operation of a key switch. A high power is supplied to the glow plug to rapidly heat the plug in the initial period. After rapid heating is completed, a low power is supplied to the glow plug to stabilize heating. In general, stable heating of the glow plug is called after glow. Warming in the combustion chamber is accelerated by the after glow, and knocking of the diesel engine is prevented. In addition, noise and white smoke are also prevented, and exhaust of an HC component is suppressed.

In a conventional energization control apparatus for a glow plug, a power transistor is connected in series with a glow plug power line. The power transistor is turned on/off to control the power supplied to the glow plug. FIG. 4 shows an example of such a conventional energization control apparatus. One terminal of a sensing resistor Ra is connected to the emitter of an npn transistor 1. Glow plugs GP1 to GP4 as glow plugs 2 are connected between the other terminal of the sensing resistor Ra and ground. In other words, a timing for applying a base voltage VB to the npn transistor 1 is controlled by a controller 3, and the ON/OFF time of the npn transistor 1 is controlled. As a result, the amount of power to be supplied to the glow plugs 2 is controlled.

A typical example of the energization control apparatus employing the above scheme is disclosed in Japanese Patent Laid-Open No. 61-25971.

In the conventional energization control apparatus for a glow plug, however, the base voltage VB has substantially the same amplitude as that of the battery voltage. When an emitter voltage VE of the transistor 1 is increased upon an increase in resistance caused by a temperature rise of the glow plugs 2, a difference (VB−VE) between the base and emitter voltages VB and BE is decreased. The transistor 1 which is supposed to be used in a saturation region is undesirably used in an active region. Therefore, energization control of the glow plug 2 cannot be stably performed.

In order to always use the npn transistor 1 in the saturation region against resistance variations (load variations) in the glow plugs 2, another conventional energization control apparatus (e.g., Japanese Utility Model Publication No. 60-34786) is known. In this apparatus, the emitter of an npn transistor 1 is grounded, and glow plugs 4 are connected to the collector of the npn transistor 1. With this circuit arrangement, bipolar glow plugs 4 must be used in place of the unipolar glow plugs 2 (glow plugs commonly grounded in the housing) shown in FIG. 4. The number of wiring lines is increased, and working inefficiency and wiring errors occur, thus degrading reliability of the energization control apparatus.

As shown in FIG. 6, still another conventional energization control apparatus is proposed (e.g., Japanese Patent Laid-Open Nos. 59-119070 and 59-122782) wherein a pnp transistor 5 is used in place of the npn transistor 1 shown in FIG. 4, and the glow plugs 2 are connected between ground and the collector of the pnp transistor 5. However, pnp transistors for driving glow plugs 2 with a large current are hard to get on the market. For this reason, easily accessible pnp transistors having a relatively small capacity are connected in parallel with each other to satisfy the need for high-power driving of the glow plugs. In this case, the pnp transistors must have identical characteristics, and therefore, the energization control apparatus becomes expensive as a whole.

SUMMARY OF THE INVENTION

It is, therefore, a principal object of the present invention to provide an energization control apparatus wherein a glow plug drive transistor can be always operated in its saturation region.

In order to achieve the above object of the present invention, there is provided an energization control apparatus for a glow plug connected between ground and an emitter of an npn transistor and turning on/off the npn transistor to control an amount of power to be supplied to the glow plug, comprising: control signal generating means (20) for generating a control signal for turning on/off the npn transistor; and base voltage boosting means, arranged between the control signal generating means and a base of the npn transistor, for boosting a base voltage such that the npn transistor is operated in a saturation region regardless of load variations.

According to the present invention, a difference between the base and emitter voltages is increased against load variations in glow plugs, thereby preventing operation of the npn transistor in the active region.

DESCRIPTION OF THE PREFERRED EMBODIMENT

Figure 1:
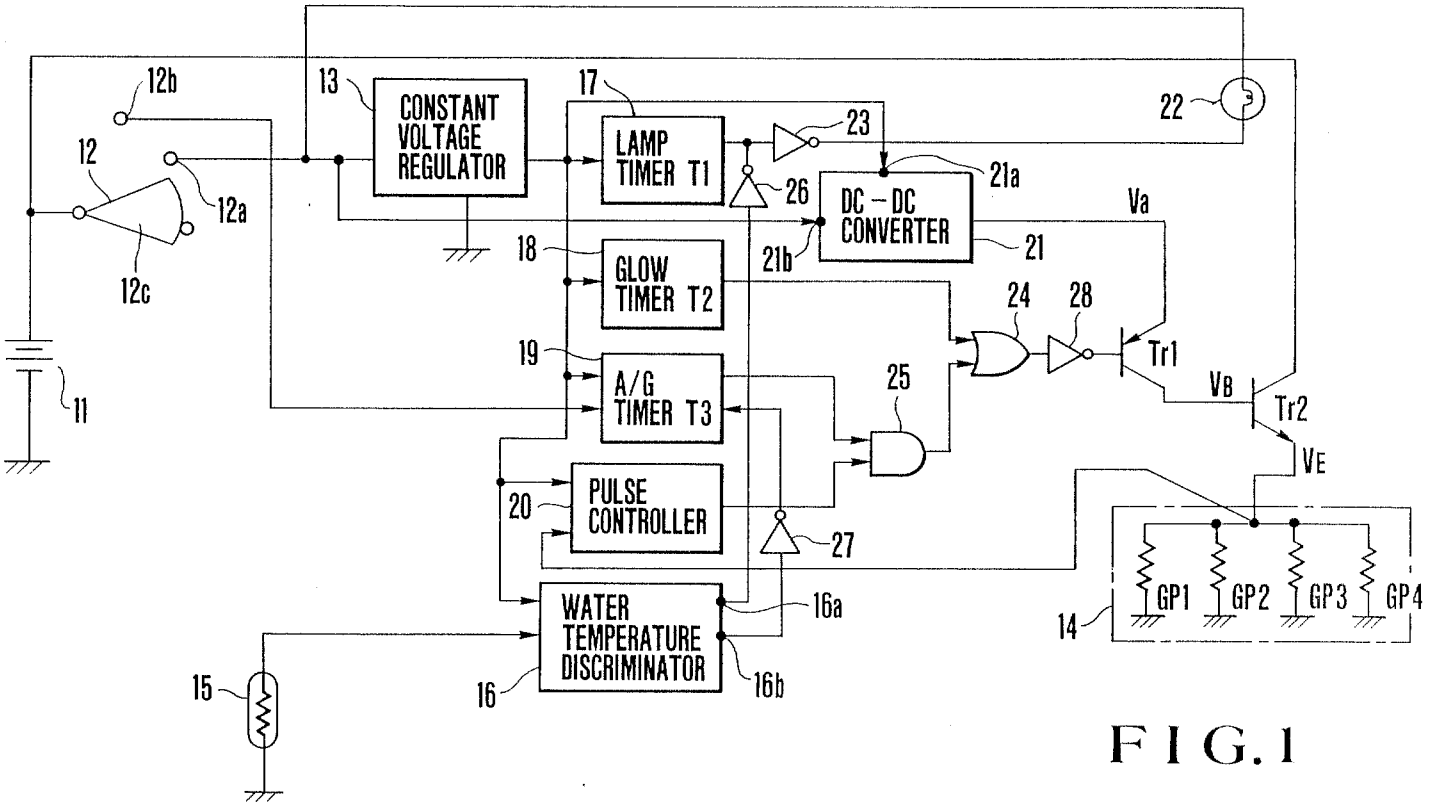
FIG. 1 is a block diagram showing an energization control apparatus for a glow plug according to an embodiment of the present invention.

An energization control apparatus according to an embodiment of the present invention will be described below. FIG. 1 shows an energization control apparatus according to an embodiment of the present invention.

Referring to FIG. 1, reference numeral 11 denotes a battery; 12, a key switch; 13, a constant voltage regulator connected to an ON terminal 12*a* of the key switch 12; 14, glow plugs respectively mounted in combustion chambers (not shown) of the cylinder head of a diesel engine; 15, a water temperature sensor for detecting a temperature of cooling water for the engine; 16, a water temperature discriminator for receiving a water temperature signal from the water temperature sensor 15 and for determining whether the detected water temperature is lower than a predetermined water temperature; 17, a lamp timer; 18, a glow timer; 19, an after glow timer; 20, a pulse controller; 21, a DC-DC converter; and 22, a glow lamp.

The lamp timer 17, the glow timer 18, the after glow timer 19, the pulse controller 20, the water temperature discriminator 16, and the DC-DC converter 21 are operated on the basis of a regulator output input through the constant voltage regulator 13 when a movable contact 12*c* of the key switch 12 is connected to the ON terminal 12*a*. In other words, upon reception of the regular output through the constant voltage regulator 13, the time counting operations of the lamp timer 17, the glow timer 18, and the after glow timer 19 are started. The lamp timer 17 outputs a timer signal of "H" level to an inverter 23 for a period of time from the start of time counting operation to a lapse of a timer time T1. The glow lamp 22 is connected between the output of the inverter 23 and the ON terminal 12*a* of the key switch 12. The glow timer 18 outputs a timer signal of "H" level to an OR gate 24 for a period of time from the start of time counting operation to a lapse of a timer time T2. The after glow timer 19 outputs a timer signal of "H" level to an AND gate 25 for a period of time from the start of time counting operation to a lapse of a timer time T3. A voltage applied to the glow plugs 14 is sequentially fed back to the pulse controller 20. The pulse controller 20 receives the regulator output through the constant voltage regulator 13 and is operated such that the pulse controller 20 supplies, to the AND gate 25, a control signal having a pulse width corresponding to an RMS of the fed-back voltage. An output from the AND gate 25 is input to the OR gate 24.

The water temperature discriminator 16 receives the regulator output through the constant voltage regulator 13 and starts a water temperature discrimination operation. If a discrimination result represents 0° C. or less, signals of "L" level appear at output terminals 16*a* and 16*b* of the water temperature discriminator 16. However, if the discrimination result represents 0° C. or more, signals of "H" level and "L" level appear at the output terminals 16*a* and 16*b*, respectively. If the discrimination result represents 20° C. or more, signals of "H" level appear at the output terminals 16*a* and 16*b*. The output terminal 16*a* of the water temperature discriminator 16 is connected to the lamp timer 17 and the inverter 23 through an inverter 26. An output signal from the output terminal 16*b* of the water temperature discriminator 16 is input to the after glow timer 19 through an inverter 27. When a signal input through the inverter 27 is set at "L" level, the time counting operation of the after glow timer 19 is forcibly stopped.

The time T1 of the lamp timer 17 is substantially equal to the time T2 of the glow timer 18. The time counting operation of the after glow timer 19 is reset when the movable contact 12*c* of the key switch 12 is connected to and then disconnected from the start terminal 12*b*.

An output from the OR gate 12 which receives the timer signal from the glow timer 18 and the output from the AND gate 25 is input to the base of a pnp transistor Tr1 through an inverter 28. An output voltage Va (DC 24 V in this embodiment) converted by the DC-DC converter 21 is applied to the emitter of the transistor Tr1. The base of an npn power transistor Tr2 is connected to the collector of the transistor Tr1. Unipolar glow plugs 14 are connected between ground and the emitter of the npn power transistor Tr2. A battery voltage (DC 12 V) is directly applied to the collector of the npn power transistor Tr2.

Figure 2:
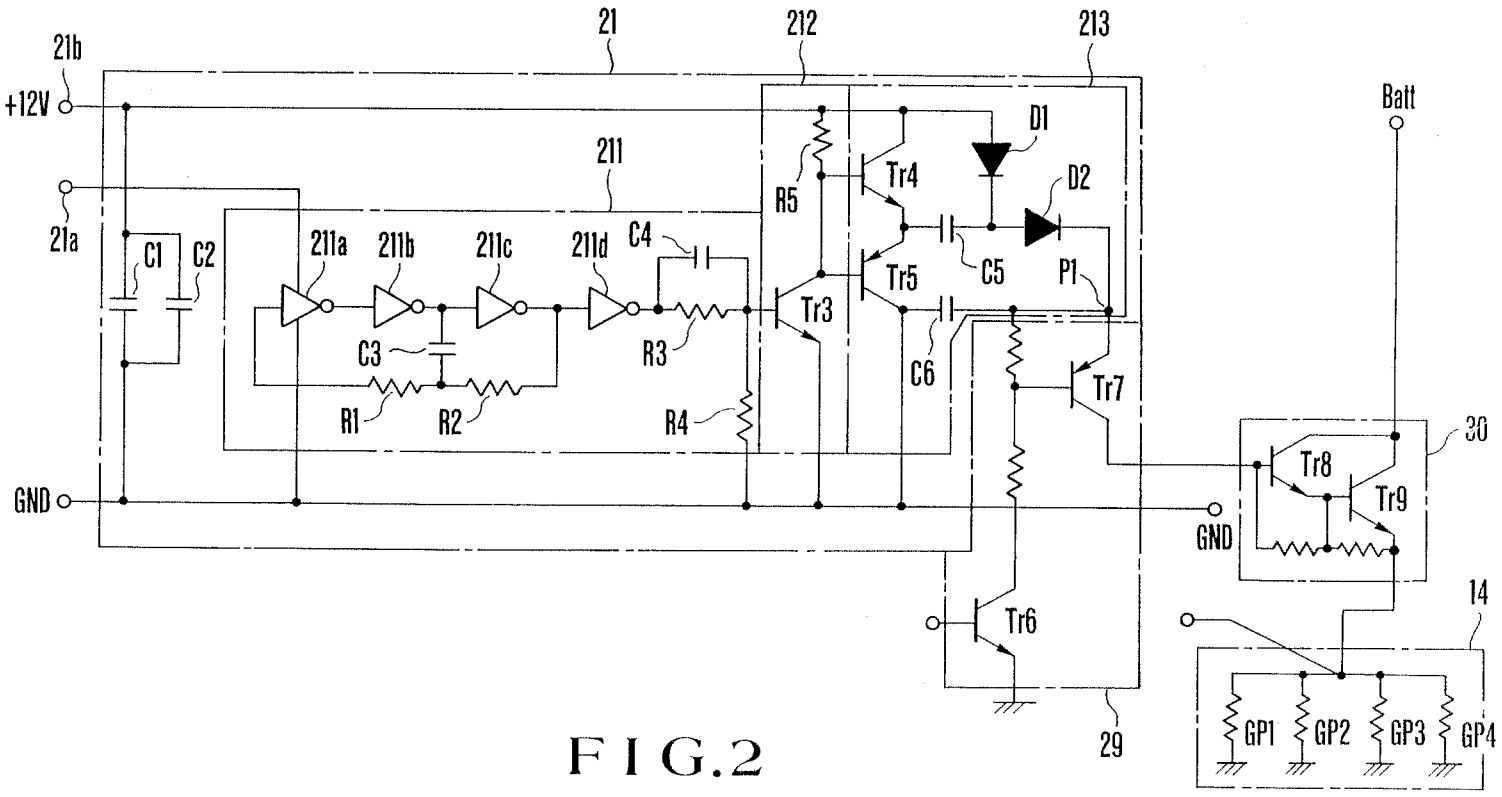
FIG. 2 is a detailed circuit diagram showing a DC-DC converter used in the above energization control apparatus.
Figure 3:
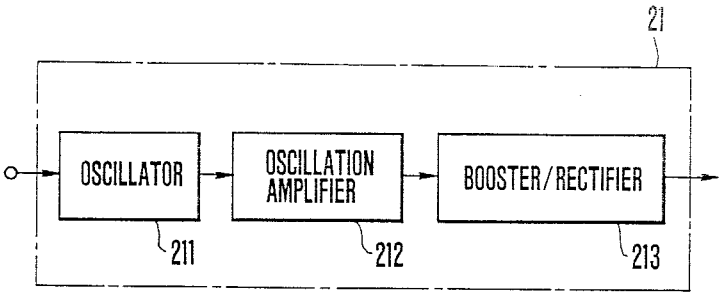
FIG. 3 is a schematic block diagram of the DC-DC converter.
Figure 4:
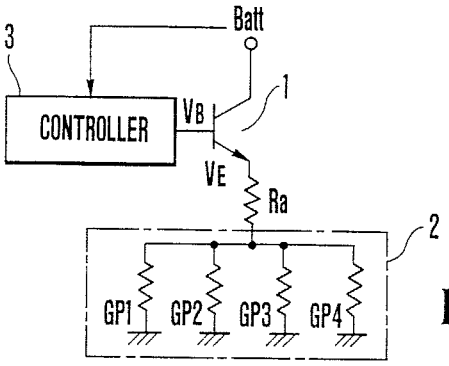
FIG.4 PRIOR ART
FIG. 4 is a circuit diagram of an energization control unit in a conventional energization control apparatus for a glow plug.
Figure 5:
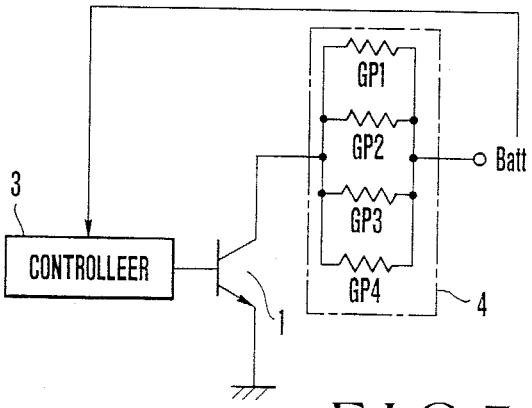
FIG. 5 is a circuit diagram of another energization control apparatus wherein glow plugs are connected to the collector of an energization control transistor.
Figure 6:
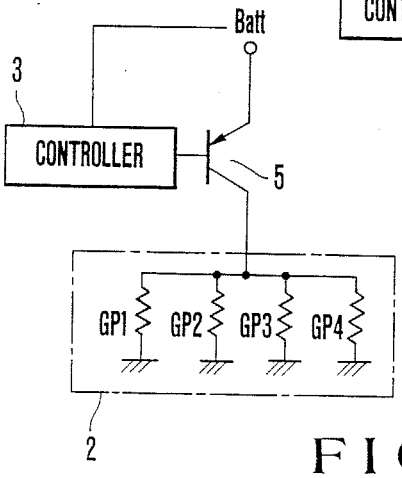
FIG. 6 is a circuit diagram showing still another energization control apparatus wherein a pnp transistor is used as an energization control transistor, and glow plugs are connected between ground and the collector of this pnp transistor.

FIG. 2 shows a detailed circuit arrangement of the DC-DC converter 21. A regulated output (constant voltage) from the constant voltage regulator 13 is applied to an input terminal 21*a*. A battery voltage through the ON terminal 12*a* of the key switch 12 is applied to an input terminal 21*b*. The DC-DC converter 21 comprises an oscillator 211, an oscillation amplifier 212, and a booster/rectifier 213, as shown in FIG. 3. As shown in FIG. 2, the ring oscillator 211 comprises four inverters 211*a* to 211*d*, resistors R1 to R4, and capacitors C3 and C4. The oscillation amplifier 212 comprises an npn transistor Tr3 and a resistor R5. The booster/-rectifier 213 comprises an npn transistor Tr4, a pnp transistor Tr5, diodes D1 and D2, and capacitors C5 and C6.

Referring to FIG. 2, a block 29 constituted by an npn transistor Tr6 and a pnp transistor Tr7 and a block 30 constituted by npn transistors Tr8 and Tr9 correspond to the pnp transistor Tr1 and npn power transistor Tr2, as shown in FIG. 1, respectively. An output (control signal) inverted through the inverter 28 (FIG. 1) is input to the base of the transistor Tr6 of the block 29.

An operation of an energization control apparatus for a glow plug having the above arrangement will be described below. Assume the key switch 12 is operated to connect the movable contact 12*c* to the ON terminal 12*a* in FIG. 1. The lamp timer 17, the glow timer 18, the after glow timer 19, the pulse controller 20, the water temperature discriminator 16, and the DC-DC converter 21 are operated on the basis of the regulator output from the constant voltage regulator 13. More specifically, the time counting operations of the lamp timer 17, the glow timer 18, and the after glow timer 19 are started, and these timers start generating signals of "H" level. In this embodiment, for illustrative convenience, assume that the discrimination result of the water temperature discriminator 16 represents 0° C. or less. In this case, the output level of the inverter 26 is set at "H" level, and an output from the inverter 23 is set at "L" level in response to the signal of "H" level from the lamp timer 17. Therefore, the glow lamp 22 is turned on.

The signal of "H" level output from the glow timer 18 is input to the OR gate 24. The OR gate 24 gates the output signal from the glow timer 18 regardless of the output state of the AND gate 25. The voltage level applied to the base of the transistor Tr1 is set at level "L" through the inverter 28. The voltage Va converted by the DC-DC converter 21 is applied to the emitter of the transistor Tr1. The transistor Tr1 is turned on, and the converted output voltage Va through the transistor Tr1 is applied as the base voltage VB to the npn transistor Tr2. Upon reception of the base voltage VB, the npn power transistor Tr2 is turned on, and the battery voltage is applied to the glow plugs 14.

The generation and output operations of the voltage Va converted by the DC-DC converter 21 will be described with reference to FIG. 2. When the regulator output (constant voltage) from the constant voltage regulator 13 is applied to the input terminal 21*a*, an oscillation output having a predetermined frequency is output from the oscillator 211. At the same time, this oscillation output is amplified to a suitable level by the oscillation amplifier 212. The amplified oscillation output from the oscillation amplifier 212 allows alternate operations of the transistors Tr4 and Tr5 in the booster/rectifier 213. The alternate operation of the transistors Tr4 and Tr5 allows charging of the capacitor C5 to a charge of 2 V+. When the capacitor C6 is charged with 2 V+, a potential at a connecting point P1 in the block 29, i.e., the converted output voltage Va from the DC-DC converter 21 is doubled, i.e., boosted to twice (DC 24 V) the input voltage (DC 12 V).

The boosted voltage Va of DC 24 V through the transistor Tr1 is used as the base voltage VB of the npn power transistor Tr2 in FIG. 1. The npn power transistor Tr2 is turned on, and the battery voltage is applied to the glow plugs 14. In this case, as compared with the case wherein the battery voltage (DC 12 V) is used as the base voltage VB, the difference (VB−VE) between the base voltage VB and the emitter voltage VE in the npn power transistor Tr2 is larger than the magnitude of the battery voltage. Even if the resistance of the glow plugs 14 is increased upon temperature increase and hence the emitter voltage VE is increased, the difference between the base voltage VB and the emitter voltage VE has a magnitude larger than the voltage value which always allows operation of the transistor in the saturation region. Therefore, the operation of the npn power transistor Tr2 in the active region, which is caused by load variations, can be prevented.

When the timer times T1 and T2 have elapsed in the lamp timer 17 and the glow timer 18, an output level of the inverter 23 goes to level "H". The glow lamp 22 is turned off, and at the same time the npn power transistor Tr2 is continuously driven on the basis of the signal from the glow timer 18. At this time, rapid heating performed by supplying a large power to the glow plugs 14 is completed. Thereafter, until the time counting operation of the after glow timer 19 is completed, the npn power transistor Tr2 is intermittently driven based on the output signal from the pulse controller 20 through the AND gate 25. Therefore, stable heating of the glow plugs 14 with a small power can be achieved. Even during intermittent driving of the npn power transistor Tr2, the difference between the base voltage VB and the emitter voltage VE is kept to have a magnitude larger than the voltage value which always allows transistor operation in its saturation region. Therefore, use of the npn power transistor Tr2 in the active region, which is caused by an increase in glow plugs 14, can be prevented.

In the above embodiment, the converted output voltage Va from the DC-DC converter 21 is set to be DC 24 V. However, the voltage value need not be specified to DC 24 V. Any voltage value may be employed if the operation of the npn power transistor Tr2 in the saturation region is assured regardless of resistance variations of the glow plugs 14.

In the energization control apparatus for a glow plug according to the present invention as has been described above, the base voltage boosting means is arranged to boost the base voltage of the npn transistor and allow the operation of the transistor in the saturation region regardless of load variations in glow plugs. The difference between the base and emitter voltages against the load variations in glow plugs can be increased. Therefore, operation of the npn transistor in the active region can be prevented. Energization control of the glow plugs can be stably performed with a simple circuit arrangement using unipolar glow plugs.

What is claimed is:

1. An energization control apparatus for a glow plug connected between ground and an emitter of an npn transistor and turning on/off said npn transistor to control an amount of power to be supplied to the glow plug, comprising:

control signal generating means (20) for generating a control signal for turning on/off said npn transistor; and base voltage boosting means, arranged between said control signal generating means and a base of said npn transistor, for boosting a base voltage such that said npn transistor is operated in a saturation region regardless of load variations.

2. An apparatus according to claim 1, wherein said base voltage boosting means comprises an oscillator (211), an amplifier (212) for amplifying an output from said oscillator (211), and a booster/rectifier (213) for boosting and rectifying an output from said amplifier, the base voltage of said npn transistor being changed in accordance with an output from said booster/rectifier.

3. An apparatus according to claim 2, further comprising a timer for controlling an ON time of said npn transistor.

4. An apparatus according to claim 1, wherein said base voltage boosting means receives a power source voltage through a key switch.

* * * * *